US007530959B2

(12) United States Patent
Matano' et al.

(10) Patent No.: US 7,530,959 B2
(45) Date of Patent: May 12, 2009

(54) DEVICE FOR THE STIMULATION OF MUSCLES OF THE LOCOMOTORY APPARATUS

(76) Inventors: Valerio Matano', Via San Giacomo De' Capri, 60, Napoli (IT) I-80128; Piero Pau, Vicolo Cerquetta, 114, Roma (IT) I-00123

( * ) Notice: Subject to any disclaimer, the term of this patent is extended or adjusted under 35 U.S.C. 154(b) by 0 days.

(21) Appl. No.: 11/630,514

(22) PCT Filed: Jun. 20, 2005

(86) PCT No.: PCT/IT2005/000357

§ 371 (c)(1),
(2), (4) Date: Dec. 21, 2006

(87) PCT Pub. No.: WO2006/001044

PCT Pub. Date: Jan. 5, 2006

(65) Prior Publication Data

US 2007/0249970 A1 Oct. 25, 2007

(30) Foreign Application Priority Data

Jun. 25, 2004 (IT) ..... RM2004A0317

(51) Int. Cl.
*A61H 1/00* (2006.01)
*A61H 1/02* (2006.01)
*A61H 5/00* (2006.01)
*A61H 7/00* (2006.01)
*A61H 19/00* (2006.01)

(52) U.S. Cl. ..... 601/23; 601/31; 601/89; 601/97; 601/104

(58) Field of Classification Search ..... 601/23, 601/27, 29, 31–33, 89–93, 97, 98, 101, 104; 5/607, 609

See application file for complete search history.

(56) References Cited

U.S. PATENT DOCUMENTS 1,709,410 A 4/1929 Simmons
5,755,651 A 5/1998 Homyonfer et al.

FOREIGN PATENT DOCUMENTS

DE 29818649 U * 3/1999
WO WO 03/057321 A1 * 7/2003
WO WO 03103858 A1 * 12/2003

* cited by examiner

*Primary Examiner*—Justine R Yu
*Assistant Examiner*—Kristen C Matter
(74) *Attorney, Agent, or Firm*—Young & Thompson

(57) ABSTRACT

A device for the stimulation of the locomotor apparatus muscles comprising a solid footboard (2), which is oscillated about a central axis (6) of oscillation having a transversal extension with respect to the footboard and dividing the latter into a first arm (A) and a second arm (B), characterized in that there is provided a drive mans operating at least one arm.

12 Claims, 4 Drawing Sheets

DEVICE FOR THE STIMULATION OF MUSCLES OF THE LOCOMOTORY APPARATUS

The present invention relates to the stimulation of the locomotor apparatus muscles, particularly those of legs and back, by the oscillation of a solid footboard.

More particularly, such footboard has one body consisting of a walking beam hinged at its transversal axis and defining two arms of the footboard.

According to a peculiar feature of the invention, the oscillation is given by drive means operating at least one arm of the footboard.

At present, there are known devices for the stimulation of the locomotor apparatus provided with a walking beam oscillating about a horizontal reference axis and with two arms projecting from such axis, each of them is associated to a respective rigid hoisting mechanism, for example, of the connecting rod/crank type which can be operated by an electric motor which is common to both arms.

A first drawback of such known devices is that they need the relative phase opposition shifts of both arms are absolutely the same to avoid for the footboard to be subjected to distortions or damages due to the exceeding of the fatigue limit as the cycles follow one another. This requires for such rigid hoisting mechanisms to be made with such a mechanical precision as to cause very high cost.

A second drawback of such known devices is that the transmission takes place by means of a pair of a serrated belts that can cause a phase difference in the movements of the respective arm hoisting mechanisms.

A third drawback is that each such hoisting mechanism has its own drive shaft of the connecting rod/crank system that should be necessarily provided with a balancing weight.

A further drawback is given by that there are a number of mechanical components needing an accurate, continuous maintenance because of wear causing vibrations that can be hardly compensated.

Therefore, the main object of the present invention is to overcome such drawbacks by providing a device for the stimulation of muscles, particularly those of legs and back, which is structurally easy and requires little maintenance.

This has been achieved according to the invention by providing a solid footboard having a body shaped as a walking beam which is oscillated about an axis of oscillation parallel to a plane of symmetry of the footboard by drive mans operating at least one arm of the footboard.

It is self-evident from the foregoing that as the arm operated by such drive means is rotated upwards, the other arm rotates downwards and vice versa.

A better understanding of the invention will result from the following detailed description with reference to the accompanying drawings that show some preferred embodiments thereof only by way of a not limiting example.

Figure 1:
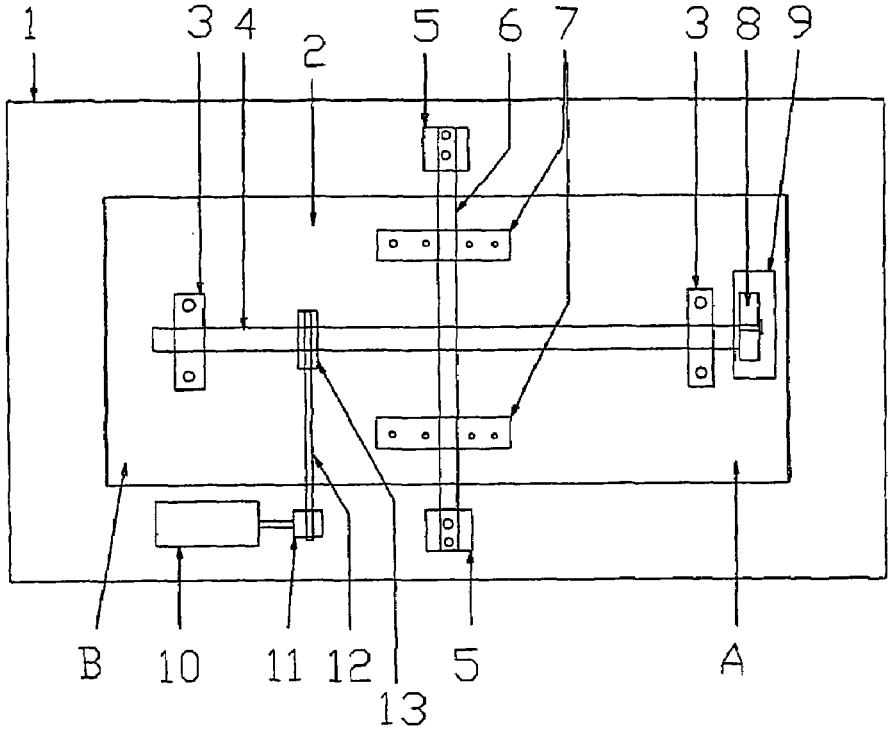
FIG. 1 is a top view of a first embodiment of the invention.
Figure 2:
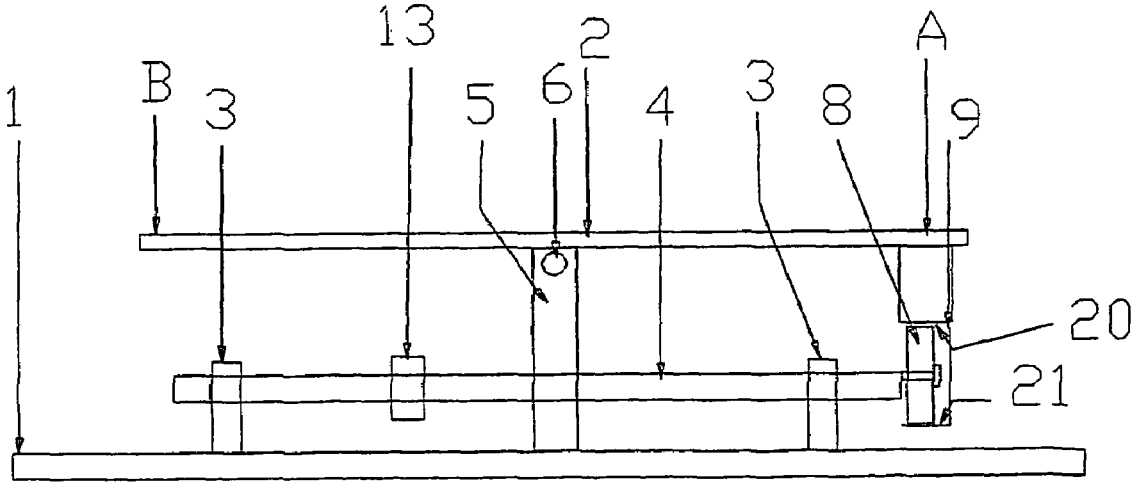
FIG. 2 is a side view of the embodiment of FIG. 1.

With reference to FIGS. 1 and 2, according to a first embodiment disclosed there is provided a device comprising a solid footboard 2 oscillating about a central axis of oscillation 6 which is transversal thereto and divides the footboard into two arms A and B, only one A of which is moved by drive means including an idle wheel 8 secured eccentrically to the end of a drive shaft 4 that rotates about its own longitudinal axis perpendicular to axis of oscillation 6 of footboard 2 that moves by its oscillation the centre of idle wheel 8 along a circumference, idle wheel 8 being inserted into a C-shaped member 9 secured under the first arm A of footboard 2 so that the open side thereof faces the centre of footboard 2. Such shaft 4 is secured to lower base 1 of footboard 2 by bearings 3 of the known type.

Idle wheel 8 is able to operate first arm A both upwards and downwards by means of upper tab 20 and lower tab 21 of C-shaped member 9.

When the motion of the centre of wheel 8 has an upward component, wheel 8 rests to the lower surface of upper tab 20 of C-shaped member 9 and first arm A performs an upward rotation of a certain amount. At the same time second arm B rotates by the same amount to the opposite direction.

Vice versa, when the motion of the centre of wheel 8 has an downward component, wheel 8 rests to the upper surface of lower tab 21 of C-shaped member 9 and first arm A performs a downward rotation of a certain amount. At the same time second arm B rotates by the same amount to the opposite direction.

Thus, footboard 2 oscillates about its own axis of oscillation 6 without its arms A and B undergo deformations.

Figure 3:
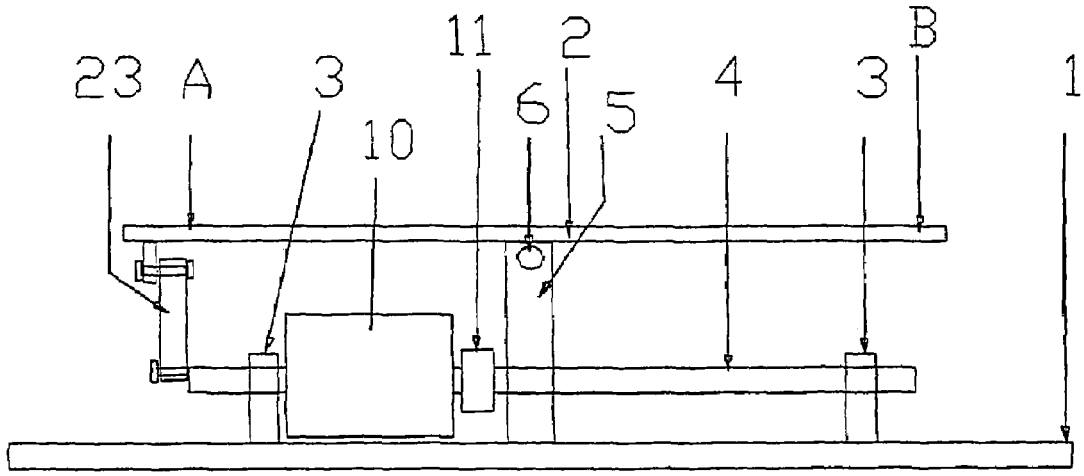
FIG. 3 is a side view of a second embodiment.

A second embodiment shown in FIG. 3 provides a mechanism of the connecting rod/crank type in alternative to wheel 8 and member 9, connecting rod 23 being able to operate first arm A of footboard 2 by its end hinged at such first arm A in a functionally equivalent way as disclosed above.

As connecting rod 23 pushes upwards first arm A to which it is connected, the latter is hoisted by a certain amount while second arm B of footboard 2 is lowered by the same amount and vice versa.

Figure 5:
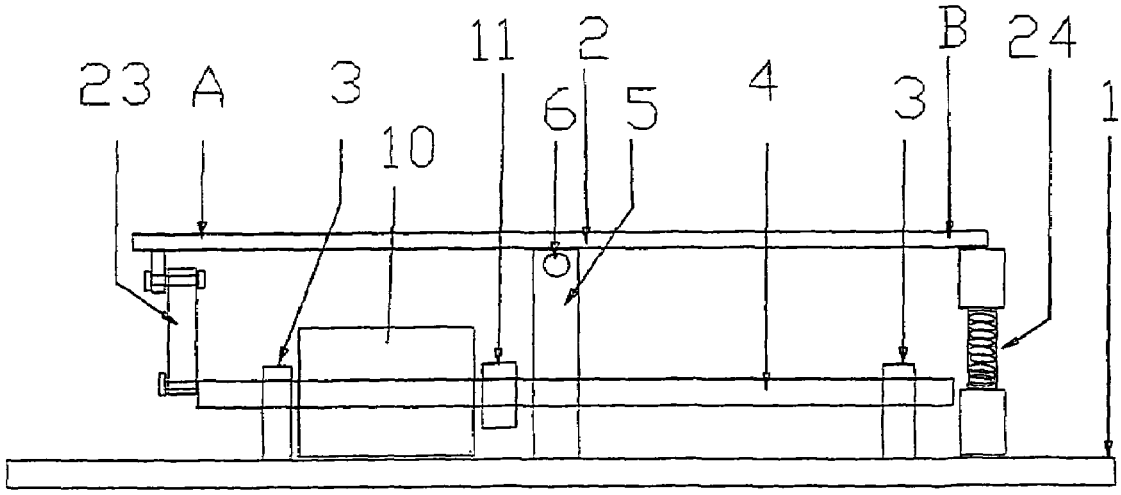
FIG. 5 is a side view of a variation of FIG. 3.
Figure 4:
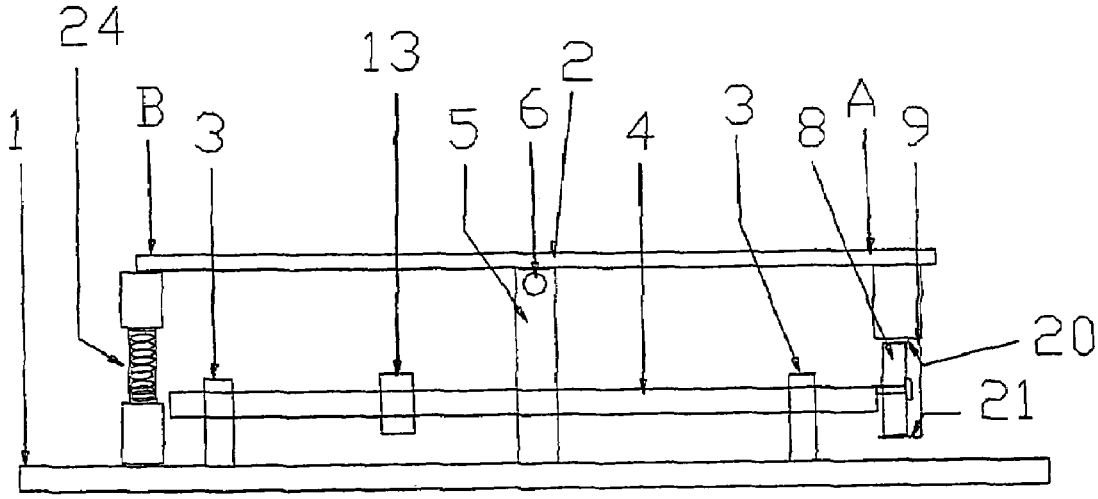
FIG. 4 is a side view of a variation of FIG. 2.

In both embodiments hitherto disclosed it is preferable that second arm B is secured to lower base 1 by a spring or shock absorber 24 located preferably near its free end (FIGS. 4 and 5).

In this case, as wheel 8 or crank 23 gives first arm A an upward or downward shift, such spring or shock absorber 24 operates to stabilize the movement of footboard 2.

Figure 6:
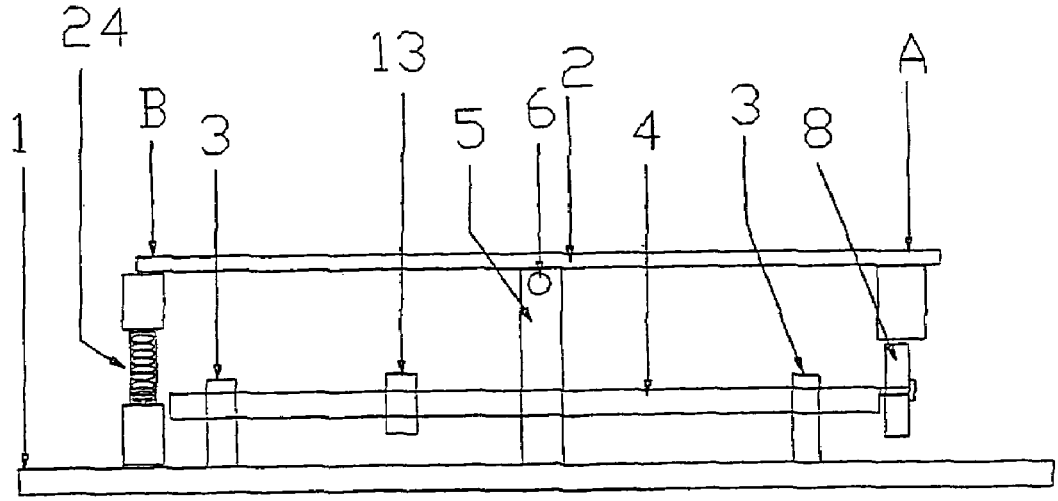
FIG. 6 is a side view of a third embodiment of the invention.

In a third simplified embodiment of the finding (FIG. 6) such wheel 8 is able only to push upwards first arm A, thus opposing the elastic force of spring or shock absorber 24 that is able in this case to push opposite arm B steadily upwards so as to move it away from base 1.

Figure 7:
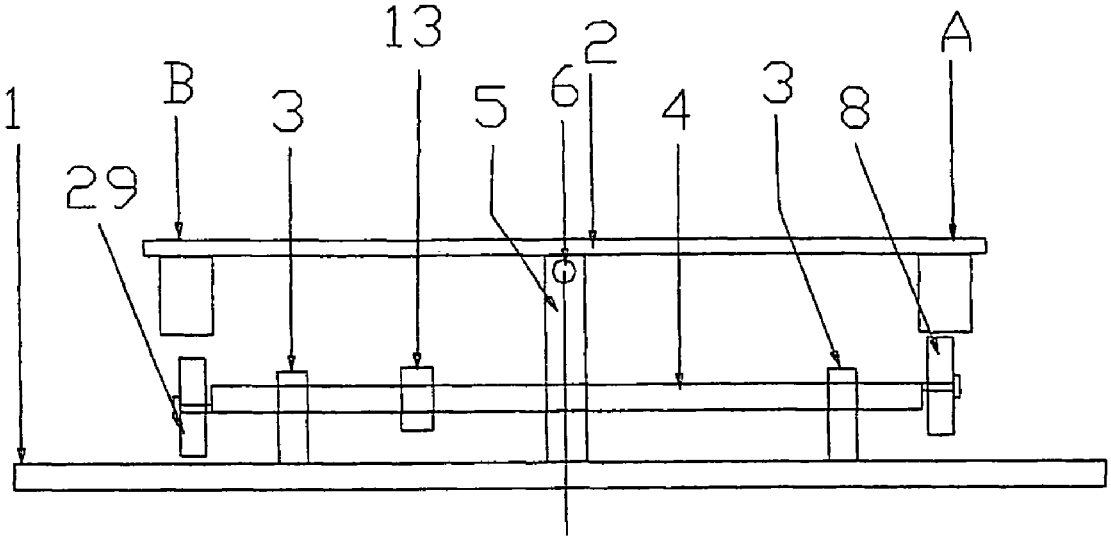
FIG. 7 is a side view of a fourth embodiment of the invention.

In a fourth embodiment of the finding (FIG. 7) drive shaft 4 is provided with two end idle wheels 8 and 29, each of them has an axis of rotation parallel to that of drive shaft 4 and is secured eccentrically thereto in a diametrically opposed position with respect to the other wheel. Thus, each wheels operates the respective arm of footboard 2 causing it to move only upwards.

In particular, when wheel 8 gives first arm A an upward shift, second arm B lowers accordingly, and when wheel 29 gives second arm B an upward shift, first arm A lowers accordingly.

Of course, as mentioned above, the vertical component of the motion of each wheel is always opposed the other.

In the illustrated examples, such drive shaft 4 is moved by a motor 10 located at its side preferably by a belt transmission 12 and pulleys 11 and 13.

Such axis of oscillation 6 is secured under footboard 2 by couplings 7 of the known type and is rotatably secured to base 1 by further bearings 5 also of the known type.

The present invention has been described and illustrated according to some preferred embodiments thereof, however, it should be understood that those skilled in the art can make technically equivalent modifications and/or replacements without departing from the scope of the present industrial invention.

The invention claimed is:

1. A device for the stimulation of locomotor apparatus muscles, said device comprising:

a solid footboard which is oscillated about a central axis of oscillation having a transversal extension with respect to the footboard and dividing the footboard into a first arm (A) and a second arm (B), a drive means which connects only to the first arm (A) and includes a C-shaped member that is shifted alternatively upwards and downwards by an idle wheel inserted inside the C-shaped-member, said C-shaped member being provided with an upper and a lower tab, said idle wheel is secured eccentrically to an end of a drive shaft that rotates about a longitudinal axis that is perpendicular to the axis of oscillation of the footboard, wherein the drive shaft operates to move the centre of the idle wheel along a circumference in a vertical plane that is perpendicular to the axis of rotation of the drive shaft, and said C-shaped member includes an open side that faces the centre of footboard and is secured under the first arm (A) of said footboard.

2. The device according to claim 1, wherein the drive shaft is secured to a lower base of said footboard by bearings.

3. The device according to claim 1, wherein said idle wheel operates the first arm (A) both upwards and downwards by means of the upper and lower tabs of the C-shaped member.

4. The device according to claim 1, wherein when motion of the centre of said idle wheel has an upward component, said idle wheel rests to a lower surface of the upper tab of said C-shaped member and gives the first arm (A) of said footboard an upward rotation of a certain amount, thus causing at the same time the second arm (B) to rotate by the same amount in an opposite direction.

5. The device according to claim 1, wherein when motion of the centre of said idle wheel has a downward component, said idle wheel rests to an upper surface of the lower tab of said C-shaped member and gives the first arm (A) of the footboard a downward rotation of a certain amount, thus causing at the same time The second arm (B) to rotate by the same amount in an opposite direction.

6. The device according to claim 1, wherein said drive means operates only the first arm (A) of the footboard and includes a connecting rod, one end of the connecting rod being hinged at the first arm (A).

7. The device according to claim 6, wherein said device is constructed so that the connecting rod is connected to the first arm (A) and pushes upwards the first arm (A) by a certain amount, and the second arm (B) of the footboard is lowered by the same amount and vice versa.

8. The device according to claim 1, wherein the second arm (B) is secured to a lower base by a spring or shock absorber located near a free end of said lower base.

9. The device according to claim 8, wherein the device is constructed so that said spring or shock absorber operates to stabilize movement of the footboard.

10. The device according to claim 1, wherein when motion of the centre of the idle wheel has an upward component, said idle wheel pushes said first arm (A) only upwards so as to oppose an elastic force of a spring or shock absorber which steadily pushes the second arm (B) only upwards.

11. The device according to claim 1, wherein said drive means connecting the first arm (A) of the footboard includes a first said idle wheel and a second said idle wheel, wherein said first and second idle wheels operate the first arm (A) and the second arm (B) of the footboard (2), respectively, each said idle wheel being secured eccentrically to a respective end of the drive shaft and having an axis of rotation parallel to the drive shaft in a diametrically opposed position with respect to the axis of rotation of the other idle wheel.

12. The device according to claim 11, wherein as the first idle wheel operating the first arm (A) gives the first arm (A) an upward shift, the second arm (B) lowers by the same shift, and as the second idle wheel operating the second arm (B) gives the latter an upward shift, the first arm (A) lowers by the same shift, the rotation movement of the axis of each end of the first and second idle wheels having a vertical component which steadily opposes that of the other idle wheel.

* * * * *